US007597239B1

(12) United States Patent
Dee et al.

(10) Patent No.: US 7,597,239 B1
(45) Date of Patent: Oct. 6, 2009

(54) GABLE TOP PAPER BOX WITH LOCKING CLOSURE

(75) Inventors: Jay M. Dee, West Chester, PA (US); Kevin Harrell, Philadelphia, PA (US)

(73) Assignee: Dee Paper Company, Inc., Chester, PA (US)

( * ) Notice: Subject to any disclaimer, the term of this patent is extended or adjusted under 35 U.S.C. 154(b) by 296 days.

(21) Appl. No.: 11/646,819

(22) Filed: Dec. 28, 2006

(51) Int. Cl.
*B65D 5/10* (2006.01)
*B65D 5/46* (2006.01)

(52) U.S. Cl. ..... 229/117.14; 229/125.42; 229/138; 229/153; 229/155

(58) Field of Classification Search ..... 229/117.14, 229/138, 139, 140, 102, 153, 125.42, 155, 229/156
See application file for complete search history.

(56) References Cited

U.S. PATENT DOCUMENTS 1,522,311 A * 1/1925 Maclellan ..... 229/117.14
1,950,104 A * 3/1934 Ewers ..... 229/101
2,523,246 A * 9/1950 Elliott et al. ..... 229/139
3,016,181 A * 1/1962 Desmond ..... 229/139
3,244,353 A * 4/1966 Miessler, Sr. ..... 229/139
3,801,001 A * 4/1974 Taylor ..... 229/139
3,853,260 A * 12/1974 Wood ..... 229/139
4,314,642 A * 2/1982 Dagostine ..... 229/212
4,782,788 A * 11/1988 Arcand ..... 229/139
4,907,140 A * 3/1990 Overstreet ..... 229/155
4,969,596 A * 11/1990 Schulbaum ..... 229/140
2005/0017062 A1 1/2005 Weintroub et al.

* cited by examiner

*Primary Examiner*—Gary E Elkins
(74) *Attorney, Agent, or Firm*—Norman E. Lehrer

(57) ABSTRACT

A paper box or carton includes front, rear and side panels with the upper portions of the side panels being configured to deform inwardly when the upper portions of said front and rear panels are brought together. In this way, a holding area is created between an inside face of a side panel and an inside face of the front panel. This holding area decreases in size as the front and rear panels are brought closer together. Each of the front and rear panels includes a flap adjacent the top portion thereof which are positionable in the holding area as the front and rear panels are moved toward each other. The flaps include distal edges that interlock with each other to maintain the upper portion of the front and rear panels together to form a closed tapered top.

7 Claims, 4 Drawing Sheets

GABLE TOP PAPER BOX WITH LOCKING CLOSURE

BACKGROUND OF THE INVENTION

The present invention is directed toward a paper box having a tapered or gable top and, more particularly, toward a gable box top which includes a locking closure that allows the top to be held tightly closed.

Small paper or cardboard boxes are used for packaging and selling thousands of different consumer products including foodstuffs, toiletries, toys, gifts and many, many others. Such boxes or cartons are usually made up from a blank comprised of a planar sheet-like material such as paper, cardboard, acetate or other similar plastics. For convenience, all such materials and equivalents thereof will be referred to herein as paper.

Many boxes utilized to sell consumer goods are simply rectangularly shaped having end flaps that may be glued closed. Other boxes, however, tend to be somewhat more fanciful and are intended not only to enclose the consumer products but also to display them. It is also frequently desired to utilize closing flaps that are not glued so that they can be opened without destroying the same. Even further, it is frequently desirable to be able to reclose the box after it has been opened and to maintain the same in a closed condition.

One type of box which has been popular is substantially rectangularly shaped but includes a tapered top. Such boxes are well known and are frequently referred to as a gable top. A prime example of a gable top box or container is the standard paperboard milk carton which has been in use for many years. By way of example, such boxes are described in U.S. Pat. Nos. 4,518,377; 4,744,467; 4,775,096 and 6,024,280.

Standard gable top boxes or cartons such as described above have tapered upper walls having their distal edges glued together. To open such cartons, the glued walls must be ripped apart. There are, therefore, no means for effectively reclosing such cartons.

Published U.S. Patent Application No. 2005/0017062 to Weintroub et al. discloses a cereal box which is essentially rectangularly shaped and which includes glued closure panels. However, once the box is opened, Weintroub et al. includes flaps that convert the box to a gable top box for reclosing. As shown most clearly in FIGS. 10 and 11 of the Weintroub et al. published application, the upper side panels of the box are configured to deform inwardly when the front and rear panels are brought together thereby creating a holding area or channel designated as 20 in the figures. This channel 20 is formed between the inside face of a side panel and the inside face of one of the front or rear panels. Flaps 21 and 22 that extend from the tops of the front and rear panels can be folded downwardly into the channel 20 as shown in FIG. 10 of Weintroub et al. in order to reclose the carton as shown in FIG. 11 thereof. The carton can then be reopened by reversing these steps.

While Weintroub et al. improves somewhat on prior cable top boxes by providing a mechanism for reclosing the same, the reclosure of Weintroub et al. is not always effective. The Weintroub et al. box or carton can frequently open on its own when it may not be desired. No means are provided for locking the flaps in their closed position.

Therefore, a need exists for a paper box or carton with a tapered or gable top that is easy to assemble and which includes an integral lock which can be opened and reclosed.

SUMMARY OF THE INVENTION

The present invention is designed to overcome the deficiencies of the prior art discussed above. In many was it is an improvement on the Weintroub et al. published application. For convenience, the entire disclosure of Weintroub et al. is incorporated herein by reference.

It is an object of the present invention to provide a paper box or carton that includes an integral locking closure.

It is another object of the present invention to provide a paper box or carton that includes an integral locking closure which can be easily assembled and which can be opened and reclosed.

It is a further object of the present invention to provide a paper box or carton that includes an integral locking closure and which is formed from a single blank of material and easily folded to form the box.

In accordance with the illustrative embodiments demonstrating features and advantages of the present invention, there is provided a paper box or carton that includes front, rear and side panels with the upper portions of the side panels being configured to deform inwardly when the upper portions of said front and rear panels are brought together. In this way, a holding area is created between an inside face of a side panel and an inside face of the front panel. This holding area decreases in size as the front and rear panels are brought closer together. Each of the front and rear panels includes a flap adjacent the top portion thereof which are positionable in the holding area as the front and rear panels are moved toward each other. The flaps include distal edges that interlock with each other to maintain the upper portion of the front and rear panels together to form a closed tapered top.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there is shown in the accompanying drawings, forms that are presently preferred; it being understood that the invention is not intended to be limited to the precise arrangements and instrumentalities shown.

DETAILED DESCRIPTION OF THE PREFERRED EMBODIMENTS

Figure 1:
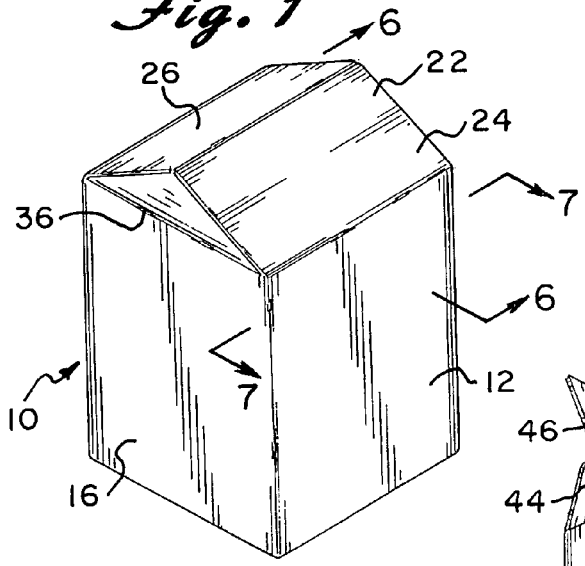
FIG. 1 is a front and top perspective view of a first embodiment of a box with a locking gable top of the present invention and shown in its fully assembled form.
Figure 3:
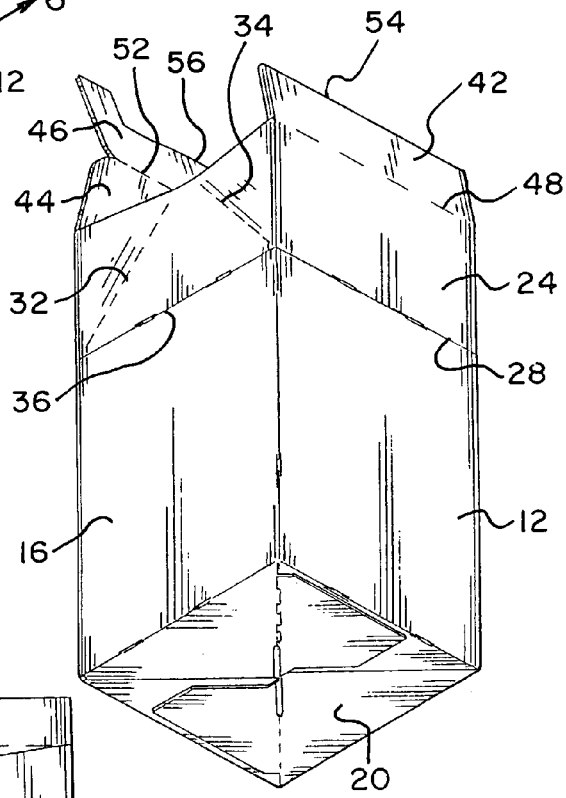
FIG. 3 is front and bottom perspective view of the box of the invention showing the same being assembled.

Referring now to the several drawings in detail wherein like reference numerals have been used throughout the various figures to designate like elements, there is shown in FIGS. 1-7 a first embodiment of a box with a locking gable top of the present invention and designated generally as 10. The box 10 of FIG. 1 is shown in its fully assembled condition. FIGS. 2-7 illustrate the box 10 in various stages of assembly.

The main portions of the box 10 are conventional. It is a substantially rectangularly shaped box having a front panel 12, a rear panel 14, a left side panel 16, a right side panel 18 and a bottom 20. Preferably all of the panels (and the remaining portion of the box 10 to be described hereinafter) are made from a single blank of material that is cut, scored, folded and glued utilizing procedures well known in the art. However, it is also possible to make the box from separate pieces that are glued or otherwise assembled together in known manners.

While reference is made herein to front, back, left and right, it should be noted that this is by way of example only and for illustration purposes. As should be readily apparent to those skilled in the art, the rear of a box could function as the front and vice versa and the left and right sides are also interchangeable.

As also known in the art, the gable top 22 of the box 10 is formed by an upper portion 24 of the front panel 12 and an upper portion 26 of the rear panel 14. A score or fold line 28 is formed between the upper portion 24 and the remaining portions of the front panel 12 and a similar score or fold line 30 is formed in the rear panel 14. This allows the upper portions 24 and 26 to be moved toward each other.

The upper portions of each of the side panels 16 and 18 include diagonal score or fold lines 32 and 34. As illustrated in the drawings, only the fold lines in the left side panel 16 can be observed. The right side panel is, however, formed in substantially the identical manner.

The fold lines 32 and 34 in the upper portion of the side panel 16 along with the horizontal fold line 36 form three triangles. As the upper portions 24 and 26 of the front and rear panels are brought together toward the center of the box 10, the upper triangular portions of the side panels 16 and 18 deform inwardly. As perhaps best shown in FIG. 5, as the upper portions of the front and rear panels are brought together, a channel or holding area 38 is formed between the inside face of the upper front triangular portion 40 of the side panel 16 and the inside face of the upper portion 24 of the front panel 12. As should also be readily apparent to those skilled in the art, this channel or holding area decreases in size, that is the thickness or depth of the channel decreases, as the upper portions 24 and 26 of the front and rear panels 12 and 14 are brought closer together.

A flap 42 extends from the top of the upper portion 24 of the front panel 12. Similarly, a two-part flap shown at 44 and 46 extends from the upper portion 26 of the rear panel 14. The front panel flap 42 includes a score or fold line 48 which allows the flap 42 to be folded inwardly. A similar fold line 50 between the flap portion 44 and the rear panel 14 allows the flap portion 44 to be folded inwardly. An additional score or fold line 52 between the rear flap portions 44 and 46 allows the flap portion 46 to fold rearwardly or upwardly toward the top of the box 10.

Figure 4:
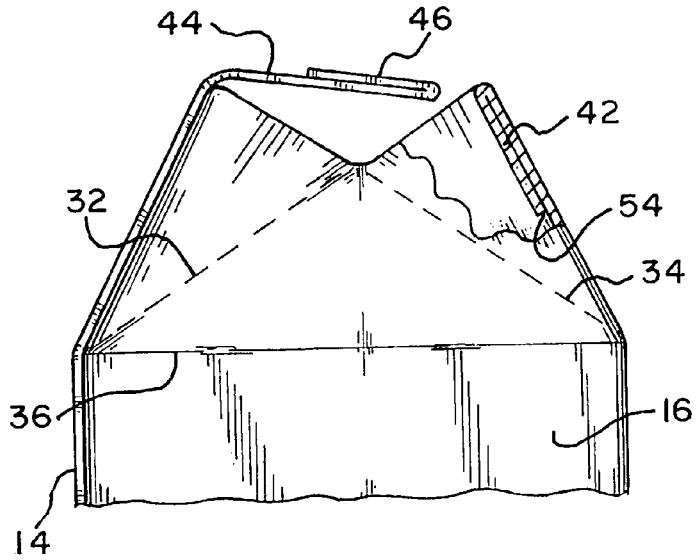
FIG. 4 is a side elevational view with a portion broken away illustrating a further step in the assembly of the box of FIG. 1.
Figure 5:
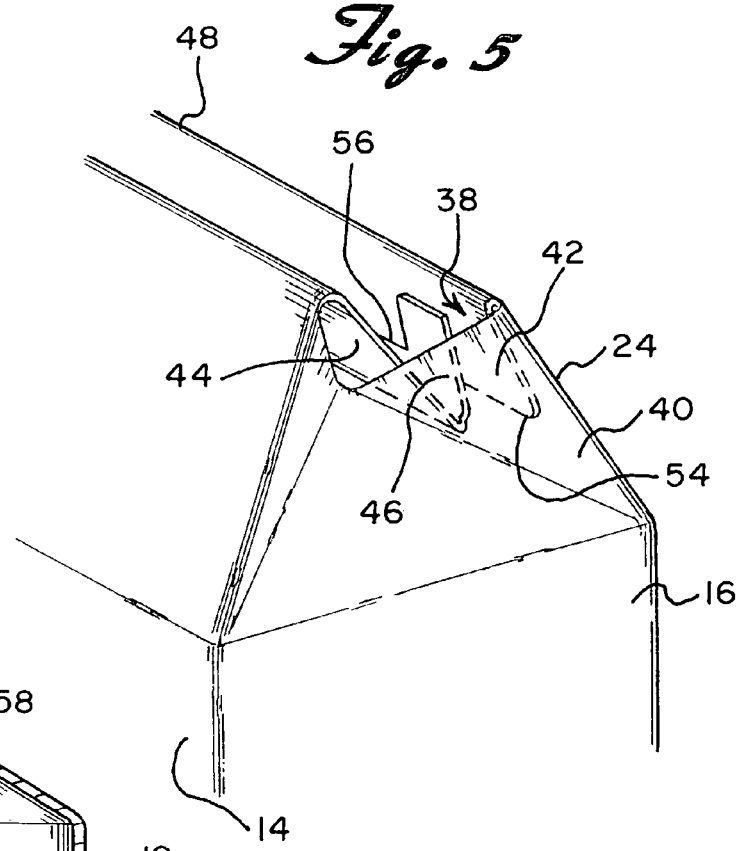
FIG. 5 is a top perspective view showing the next step in the assembly of the box following FIG. 4.

As shown most clearly in FIGS. 4 and 5, as the upper portions 24 and 26 of the front and rear panels 12 and 14 are moved together forming the channel or holding area 38, the flaps 42, 44 and 46 are folded down inwardly into the channel 38. In practice, the flap 42 is preferably folded first down into and against the inner surface of the upper portion 24 of the front panel 12 before the front and rear panels are moved toward each other. For convenience and ease of assembly, it may sometimes be preferable to have the flap 42 prefolded and glued against the inner surface of the upper portion 24 of the front panel 12.

As is also shown most clearly in FIGS. 4 and 5, when the front panel flap 42 and rear panel flap portions 44 and 46 are folded and inserted into the channel or holding area 38, the distal edge 54 of the front panel flap 42 faces essentially downwardly. The distal edge 56 of the portion 46 of the rear flap, on the other hand, faces upwardly.

Figure 2:
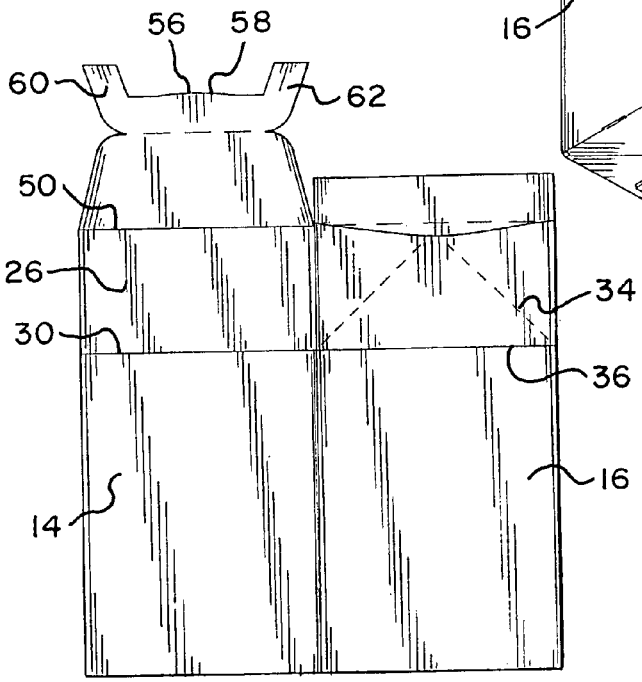
FIG. 2 is an elevational view of a partially assembled blank used to form the box of FIG. 1.
Figure 6:
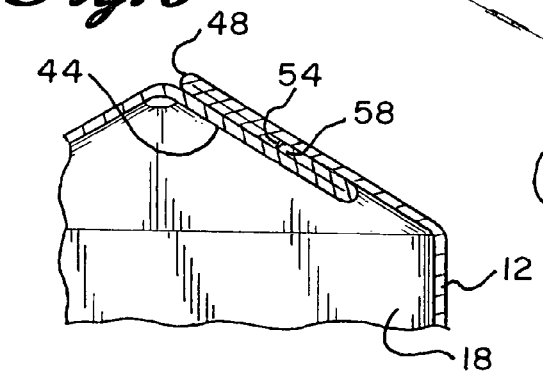
FIG. 6 is a cross-sectional view of the gable of the fully assembled box taken through the line 6-6 of FIG. 1.
Figure 7:
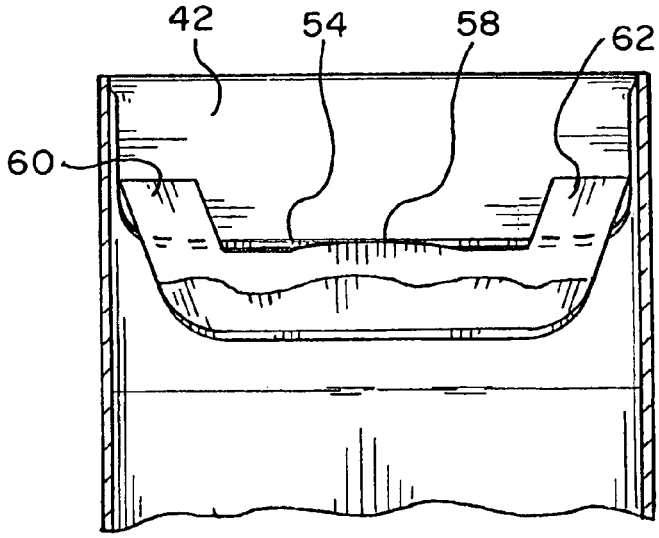
FIG. 7 is a cross-sectional view of a portion of the fully assembled box taken through the line 7-7 of FIG. 1.
Figure 9:
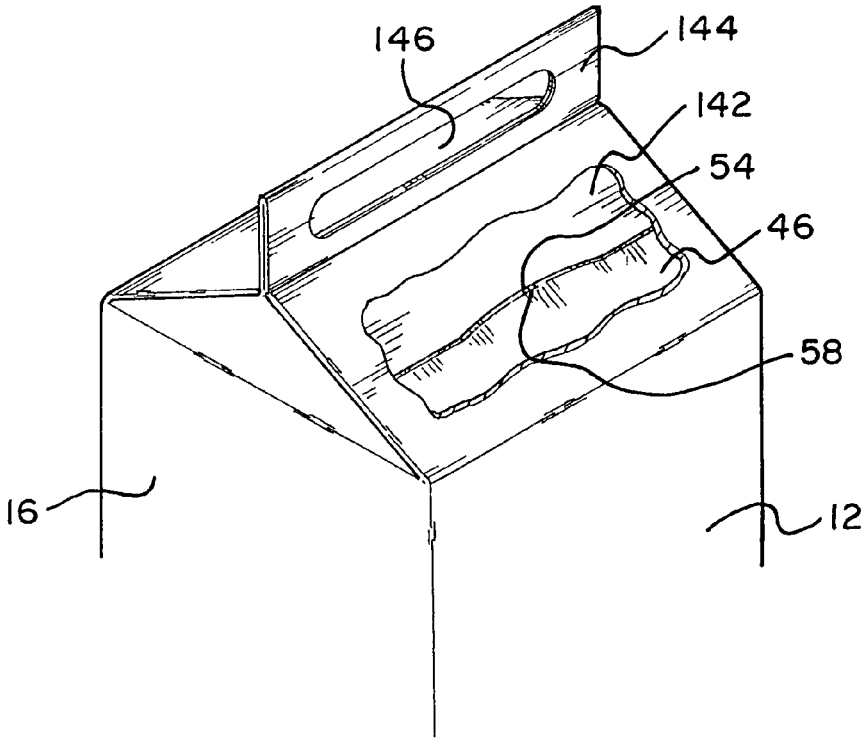
FIG. 9 is a view similar to FIG. 8 with a portion cut away to better illustrate the operation of the locking feature of the invention.
Figure 8:
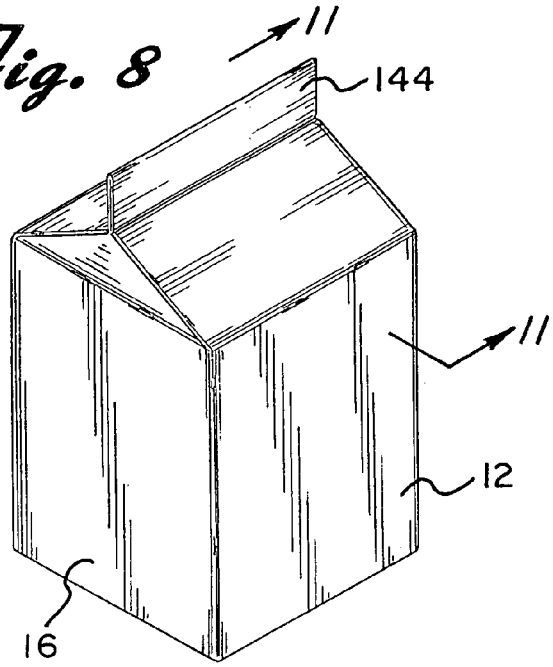
FIG. 8 is a view similar to FIG. 1 but showing a second embodiment of the invention.
Figure 10:
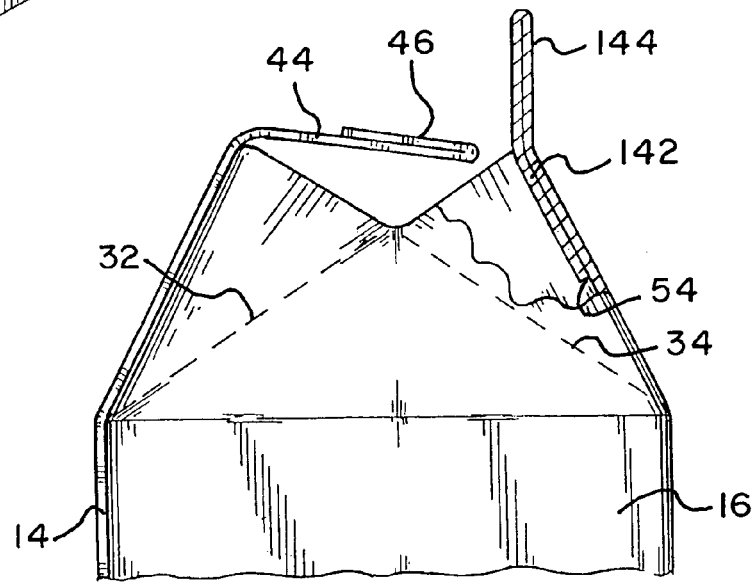
FIG. 10 is a view similar to FIG. 4 but showing the second embodiment of the invention.
Figure 11:
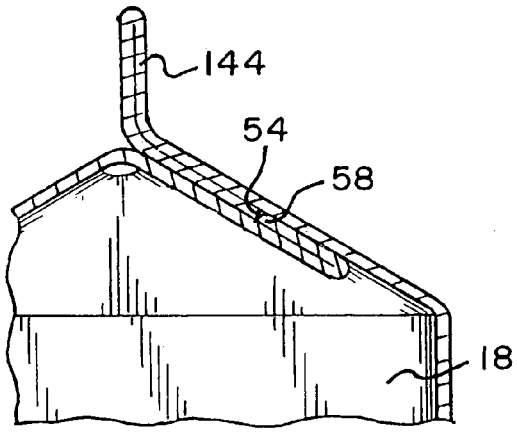
FIG. 11 is a cross-sectional view of the gable of the fully assembled box of the second embodiment taken through the line 11-11 of FIG. 8.

The center portion of the distal edge 56 of the flap portion 46 is convexly curved as shown best in FIGS. 2 and 7. The sides of the rear flap portion 46, on the other hand, include a pair of tabs 60 and 62 that extend upwardly above the curved portion 58. When the gable top 22 is properly assembled, the center portion 58 of the upwardly facing edge of the flap portion 46 will lie beneath and engage the downwardly facing distal edge 54 of the front panel flap 42 as best shown in FIGS. 6 and 7. Only the centermost portion 58, however, of the distal edge of the rear panel flap portion 46 will engage the edge 54 of the flap 42. The upstanding tabs 60 and 62 will prevent the remaining portions of the flap 46 from engaging the edge 54. Thus, the two engaged edges 58 and 54 that form a lock to maintain the gable 22 in its closed position can be disengaged by simply inserting one's finger or a knife or similar tool into the channel or holding area 38.

The embodiments of the invention shown in FIGS. 8-11 function in essentially the same way as the first embodiment described above. The only difference being in that the flap 142 of the front panel 12 is longer and when folded over upon itself forms an upstanding wall or handle portion 144. As shown in the embodiment in FIG. 9, the handle portion 144 can also have an opening 146 formed therein to further aid as a handle or merely for decorative purposes.

The present invention may be embodied in other specific forms without departing from the spirit or essential attributes thereof and accordingly, reference should be made to the appended claims rather than to the foregoing specification as indicating the scope of the invention.

We claim:

1. A paper box comprising: front, rear and side panels, at least the upper portions of said side panels being configured to deform inwardly when the upper portions of said front and rear panels are brought together such that a holding area is created between an inside face of at least one of said side panels and an inside face of said front panel, said holding area decreasing in size as the front and rear panels are brought closer together, each of said front and rear panels including a flap adjacent the top portion thereof, said flaps being positionable in said holding area as said front and rear panels are moved toward each other, said flaps interlocking with each other when positioned within said holding area to maintain the upper portion of said front and rear panels together to form a closed tapered top for said box, wherein said front panel flap includes a distal edge that faces downwardly when positioned in said holding area and wherein said rear panel flap includes a distal edge that faces upwardly when positioned in said holding area, at least a portion of the distal edge of said rear flap lying beneath and engaging at least a portion of the distal edge of said front flap.

2. The paper box as claimed in claim 1 wherein at least the middle area of said distal edge of said rear flap is convexly curved.

3. The paper box as claimed in claim 2 wherein said distal edge of said rear flap includes tabs at the sides thereof that extend upwardly beyond the distal edge of said front flap when said flaps are positioned in said holding area.

4. The paper box as claimed in claim 1 wherein the side panels of said box are each provided with preformed fold lines to aid in the deformation thereof.

5. The paper box as claimed in claim 4 wherein the side panels of said box are each provided with a pair of preformed fold lines forming a plurality of triangular shapes.

6. The paper box as claimed in claim 1 wherein said front panel includes an additional flap that extends upwardly when the box is assembled to form a handle for said box.

7. The paper box as claimed in claim 6 wherein the handle formed by said additional flap includes an opening passing therethrough.

* * * * *